United States Patent [19]

Quickel

[11] Patent Number: 4,893,383

[45] Date of Patent: Jan. 16, 1990

[54] HALTER BUCKLE

[76] Inventor: Charles C. Quickel, Rte. 1, Box 106C, Salisaw, Okla. 74955

[21] Appl. No.: 305,568

[22] Filed: Feb. 3, 1989

Related U.S. Application Data

[63] Continuation-in-part of Ser. No. 181,548, Jul. 27, 1988.

[51] Int. Cl.[4] ..... A44B 11/25

[52] U.S. Cl. ..... 24/647; 24/648

[58] Field of Search ..... 24/647, 648, 645, 646, 24/643, 644, 641, 651, 637, 638, 635, 171, 189

[56] References Cited

U.S. PATENT DOCUMENTS

| | | | |
|---|---|---|---|
| 690,659 | 1/1902 | Ney | 24/645 |
| 2,902,737 | 9/1959 | Moran | 24/645 |
| 3,090,092 | 5/1963 | Szemplak et al. | 24/648 |
| 3,435,492 | 4/1969 | Banas | 24/647 |
| 3,789,467 | 2/1974 | Aratani et al. | 24/648 |
| 4,321,734 | 3/1982 | Gandelman | 24/648 |
| 4,455,718 | 6/1984 | Finnern | 24/573 |
| 4,687,236 | 8/1987 | Rasche | 24/645 |

FOREIGN PATENT DOCUMENTS

| | | | |
|---|---|---|---|
| 2949923 | 6/1981 | Fed. Rep. of Germany | 24/645 |
| 085148 | 5/1965 | France | 24/647 |
| 1151229 | 5/1969 | United Kingdom | 24/648 |
| 1255275 | 12/1971 | United Kingdom | 24/647 |

*Primary Examiner*—Victor N. Sakran

*Attorney, Agent, or Firm*—Dunlap, Codding, Peterson & Lee

[57] ABSTRACT

A buckle is provided for use with a halter. The buckle includes a first coupler sized for close fitting insertion into a second coupler. A triangular shaped latch is pivotally secured within the second coupler for retaining the first coupler therein. A spring is enclosed within the latch for biasing the latch in a locking position.

11 Claims, 2 Drawing Sheets

HALTER BUCKLE

CROSS REFERENCE TO RELATED APPLICATION

This is a continuation-in-part of application Ser. No. 181,548 entitled Quick Halter Buckle filed July 27, 1988.

BRIEF SUMMARY OF THE INVENTION

1. Field of Invention

The present invention relates generally to quick release buckles.

2. Background of the Invention

The present invention provides an efficient, economical buckle system for use with animal halters.

Generally, when attaching a halter to an animal, such as a horse, one or more straps having punch holes therein are threaded through corresponding buckles. The strap is pulled against the frame of the buckle until the halter is properly positioned on the animal. The prong of the buckle is then inserted through an aligned punch hole in the strap for securing the strap on buckle. The halter is removed from the animal by pulling the strap against the frame of the buckle until the prong of the buckle releases the strap. The strap may then be threaded back through the buckle and the halter removed. In certain instances, the halter may be secured to and removed from the animal several times over the course of a day, thus requiring repetitive manipulation of the halter straps through the buckle.

Additionally, when the halter is secured to a field animal, the halter straps may become wet and/or the associated hardware impacted with debris. Under these conditions, the time and effort required to manipulate the halter straps through the impacted hardware may be substantial.

The present invention eliminates many of these disadvantages by providing a quick connecting and releasing buckle for use with a halter. The buckle of the present invention can be connected with minimal effort and may be released with one hand. Additionally, the present invention is designed such that the internal components of the buckle are shielded from debris, thus ensuring reliable operation of the buckle.

DESCRIPTION OF PREFERRED EMBODIMENTS

Figure 1:
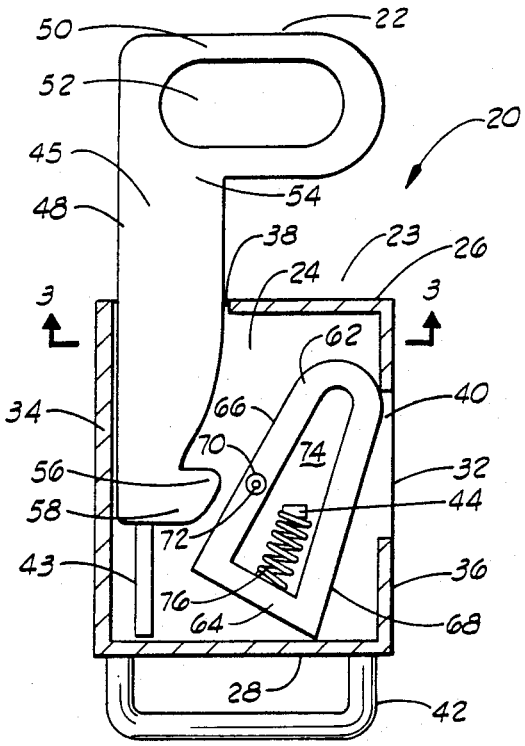
FIG. 1 is a vertical cross-sectional view of a buckle constructed in accordance with the invention showing portions in elevation for clarity of illustration.
Figure 2:
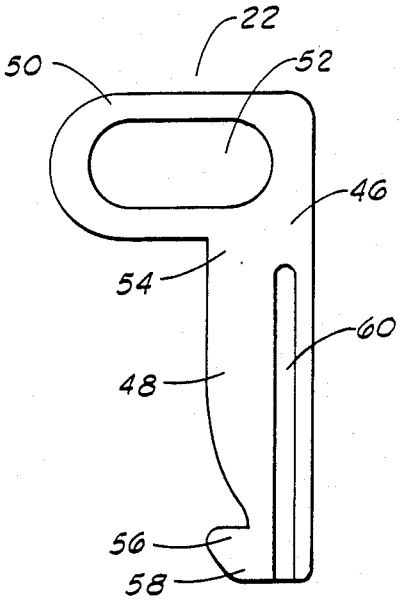
FIG. 2 is a side view of the second coupler.

Referring to the drawings in detail, and particularly to FIG. 1, the present invention comprises a buckle designated generally by the reference numeral 20. The buckle includes a first coupler 22 and a second coupler 23.

Figure 4:
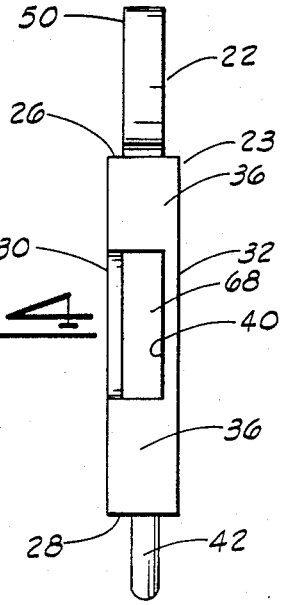
FIG. 4 is a side elevational view of the buckle.

The second coupler 23 has a cavity 24 defined by a top wall 26, a bottom wall 28, a front wall 30 (FIG. 4), a rear wall 32, a first side wall 34 and a second side wall 36. The second coupler 23 also includes a first rectangular aperture 38 in the op wall 26 adjacent the first side wall 34. The first rectangular aperture 38 is sized for receiving a portion of the first coupler 22. The second coupler 23 further includes a second rectangular aperture 40 in the second side wall 36, extending between the front wall 30 and the rear wall 32. The front wall 30 has a notch 41 aligned with the second aperture 40 (FIG. 5) for a purpose to be discussed below. A U-shaped ring 42 is secured on the bottom wall 28 for receiving a halter strap (not shown).

Figure 3:
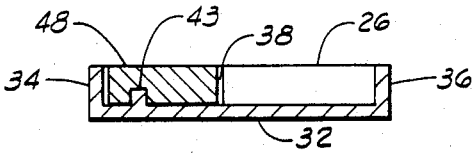
FIG. 3 is a cross-sectional view of the buckle taken along lines 3—3 of FIG. 1 with one side plate removed.

As shown in FIGS. 1 and 3, a guide 43 is secured to and extends inwardly from the rear wall 32. The guide 43 runs substantially the length of the rear wall 32 and is spaced a distance from and in parallel alignment with the first side wall 34. The rear wall 32 also includes a shoulder 44 for a purpose to be discussed below.

The first coupler 22 has a front side 45 and a rear side 46. The first coupler 22 further includes a tongue 48 and a head 50, having an oval aperture 52 for receiving a halter strap (not shown). The head 46 is integral with an upper end 54 of the tongue 48. The tongue 48 also includes a lip 56 adjacent the lower end 58 of the tongue. The tongue 48 further includes a groove 60 in the rear side 46 thereof, extending from the lower end 58 and 10 terminating in the upper end 54 of below the level of the head 50.

The tongue 48 is sized for close fitting cooperation with the portions of the buckle defining the first rectangular aperture 38. Additionally, the groove 60 is sized for a close sliding fit with the guide 43. In this way, not only is the lateral movement of the tongue 48 within the second coupler 23 reduced but, any debris attached to the tongue 48 is substantially removed therefrom when the first coupler 22 and the second coupler 23 are united.

As shown in FIG. 1, the buckle 20 also includes a triangular shaped latch 62 having a base 64, a first side 66 and a second side 68. The first side 66 has an aperture 70 therein. A pin 72 is inserted through the aperture 70 and secured within the cavity 24 between the front wall 30 and the rear wall 32. In this way, the latch 62 pivots on the pin 72 within the cavity 24. The latch 62 also has a triangular shaped opening 74 therethrough defined by the base 64, the first side 66 and the second side 68. The opening 74 is sized for receiving the shoulder 44 and a spring 76. The spring 76 is compressed between the shoulder 44 and the base 64 of the latch 62. In this way, the force of the spring 76 biases the latch 62 into a locking position (FIG. 6). It will now be appreciated that the second aperture 40 in combination with the notch 41 provides a finger access to the second side 68 of the latch 62, such that the latch 62 may be pivoted between the locking position (FIG. 6) and an unlocking position (FIG. 5).

Figure 5:
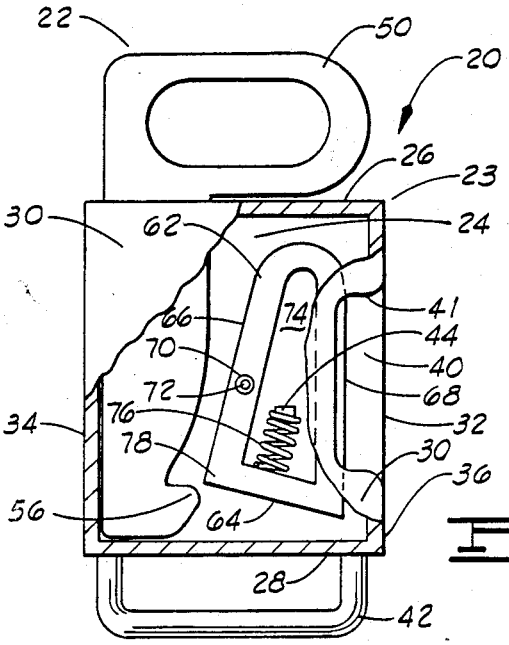
FIG. 5 is a side view of the buckle with portions broken away illustrating the internal components in an unlocking position.
Figure 6:
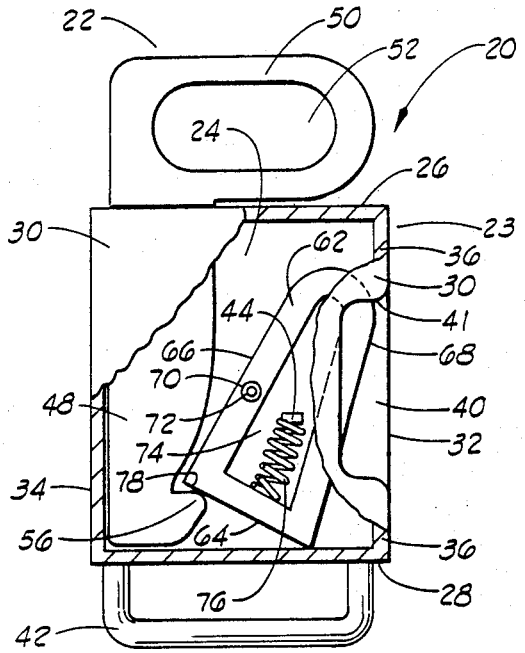
FIG. 6 is a similar view of the buckle in FIG. 5 illustrating the internal components in a locking position.

As shown in FIG. 5, when the latch 62 is positioned in the unlocking position, the base 64 is rotated towards the second side wall 36 such that a corner 78, defined by the intersection of the base 64 and the second side 68, does not overlie the lip 56. In this position, the first coupler 22 may be removed from the second coupler 23. Conversely, as shown in FIG. 6, when the latch 62 is positioned in locking position, the base 64 rotates away from the second side wall 36 and towards the tongue 48 such that the corner 78 overlies the lip 56. In this position, the first coupler 22 is retained within the second coupler 23.

It will be appreciated that in the embodiment illustrated in FIGS. 5 and 6, the notch 41 is sized such that portions of the front wall 30 overlie portions of the second side 68 of the latch 62 when the latch is pivoted between the locking and the unlocking positions. In this way, the entire opening 74 of the latch 62 is enclosed within the second coupler 23 and debris is prevented from entering the opening 74 to possibly interfere with the operation of the spring 76. It will be further appreciated that portions of the second side 68 of the latch 62 adjacent the notch 41 extend outwardly from the notch 41 when the latch is pivoted between the locking and the unlocking positions.

Figure 7:
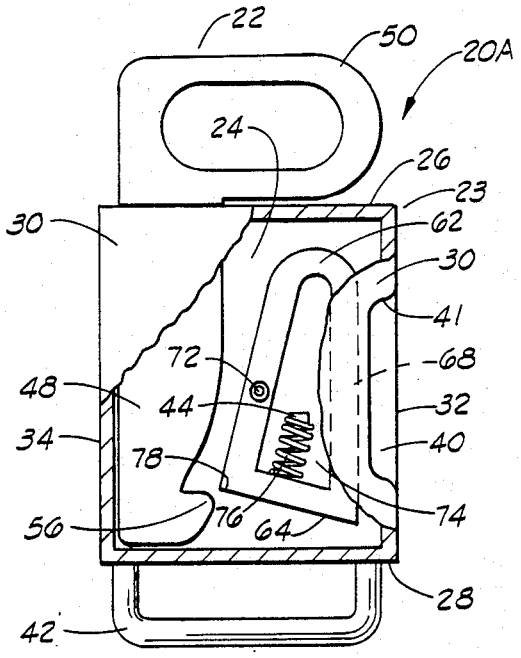
FIG. 7 is a side view of a modified buckle with portions broken away illustrating the internal components in an unlocking position.
Figure 8:
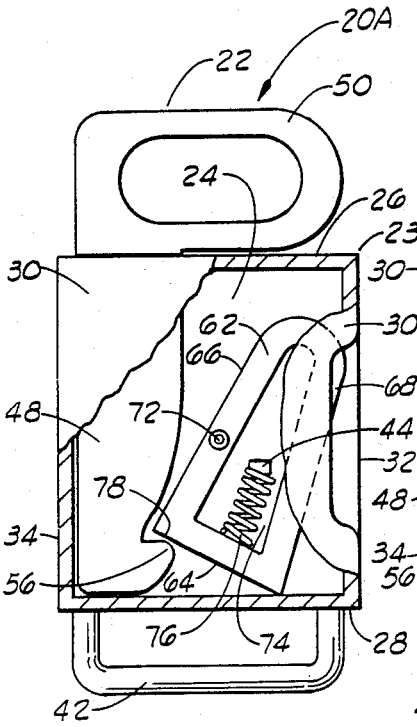
FIG. 8 is a similar view of the buckle in FIG. 7 illustrating the internal components in a locking position.

The embodiment shown in FIGS. 7 and 8 and designated by reference character 20A is similar to the embodiment 20 shown in FIGS. 5 and 6, except that portions of the front wall 30 completely overlie the second side 68 of the latch 62 when the latch 62 is in the unlocking position (FIG. 7). In this way, movement of the latch 62 from the locking position to the unlocking position by inadvertent contact is essentially prevented.

Figure 9:
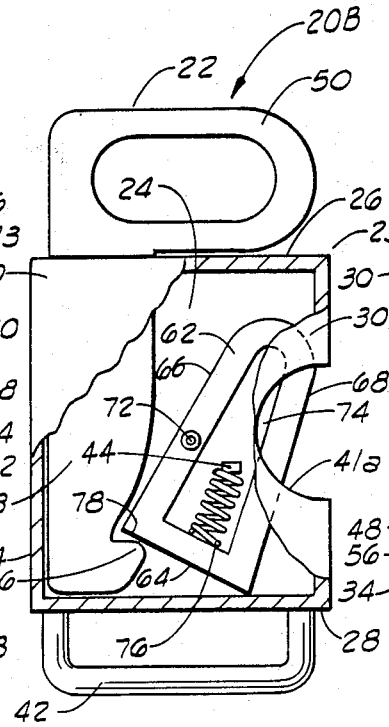
FIG. 9 is a side view of another modified buckle with portions broken away illustrating the internal components in a locking position.
Figure 10:
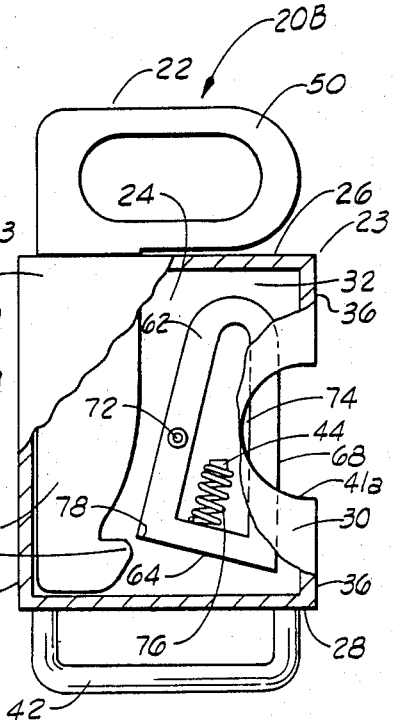
FIG. 10 is a similar view of the buckle in FIG. 9 illustrating the internal components in an unlocking position.

The embodiment shown in FIGS. 9 and 10 and designated by reference character 20B is similar to the embodiments 20 and 20A with the exception that both the front wall 30 and the rear wall 32 have similar sized, vertically aligned notches 41*a* therein. In this embodiment, the notches 41*a* are sized such that portions thereof overlie portions of the opening 74 in the latch 62. In this way, the spring 76 is substantially but not completely enclosed within the second coupler 23.

Changes may be made in the construction, operation, and arrangement of the various parts, elements, and procedures described herein without departing from the spirit and scope of the invention as defined in the following claims.

I claim:

1. A buckle comprising:

a first coupler;

a second coupler, having a cavity therein sized for receiving the first coupler;

a latch for selectively retaining the first coupler within the second coupler, wherein the latch is pivotally secured to the second a latch for selectively retaining the first coupler within the second coupler, wherein the latch is pivotally secured to the second coupler for movement between a locking position and an unlocking position;

means for biasing the latch into the locking position;

and means for enclosing the means for biasing within the latch, wherein the means for enclosing the means for biasing is characterized by the latch having an opening therein, and wherein the means for biasing the latch is contained within the opening.

2. A buckle comprising:

a first coupler;

a second coupler, having a cavity defined by a top wall, a bottom wall, a front wall, a rear wall, a first side wall and a second side wall, wherein the cavity is sized for receiving the first coupler;

a latch, having an opening therein, for selectively retaining the first coupler within the second coupler, wherein the latch is pivotally secured in the second coupler for movement between a locking position and an unlocking position; and means enclosed within the opening for biasing the latch into the locking position.

3. The buckle of claim 2 wherein the means for biasing comprises a spring.

4. The buckle of claim 2 wherein the latch is triangular shaped, and wherein the biasing means is compressed between a portion of the second coupler extending into the opening and a portion of the latch defining the opening.

5. A buckle comprising:

a first coupler;

a second coupler having a cavity defined by a top wall, a bottom wall, a front wall, a rear wall, a first side wall and a second side wall, wherein the cavity is sized for receiving the first coupler, and wherein the rear wall has a shoulder extending into the cavity;

a latch, for selectively retaining the first coupler within the second coupler, having an opening therein sized for receiving the shoulder, wherein the latch is pivotally secured in the second coupler for movement between a locking position and an unlocking position; and means enclosed within the opening for biasing the latch into the locking position, wherein the means for biasing is compressed between the shoulder and a portion of the latch defining the opening.

6. The buckle of claim 5 wherein the means for biasing comprises a spring.

7. The buckle of claim 5 wherein the latch is triangular shaped.

8. The buckle of claim 5 wherein the means for biasing is substantially enclosed within the second coupler.

9. A buckle comprising a first coupler having an upper end and a lower end and oval aperture for receiving a strap in the upper end and a lip at the lower end, wherein the first coupler is further characterized as having a groove therein beginning at the lower end and extending substantially the length of the first coupler, terminating below the level of the oval aperture;

a second coupler having a cavity defined by a top wall, a bottom wall, a front wall, a rear wall, a first side wall and a second side wall, wherein the cavity is sized for receiving the lower end of the first coupler, and wherein the second coupler has a guide therein, secured to and extending inwardly from the rear wall, the guide being sized for cooperation with the groove of the first coupler when the first coupler is inserted into the cavity, and wherein the rear wall also has a shoulder extending therefrom;

a triangular shaped latch, having an triangular shaped opening therein sized for receiving the shoulder, pivotally secured to the second coupler within the cavity for movement between a locking position and an unlocking position, such that when the first coupler is fully inserted into the cavity, and the triangular shaped latch is positioned in the locking position, a portion of the triangular shaped latch overlies the lip of the first coupler such that the first coupler is retained within the second coupler, and when the first coupler is fully inserted into the cavity, and the triangular shaped latch is positioned in the unlocking position, the first coupler is separable from the second coupler;

means enclosed within the triangular shaped opening for biasing the latch in the locking position, wherein the means for biasing is compressed between a portion of the shoulder extending into the opening and a portion of the latch defining the opening.

10. The buckle of claim 9 wherein the means for biasing comprises a spring.

11. The buckle of claim 9 wherein the means for biasing the latch in the locking position is substantially enclosed within the triangular shaped opening.

* * * * *

UNITED STATES PATENT AND TRADEMARK OFFICE

CERTIFICATE OF CORRECTION

PATENT NO. : 4,893,383

DATED : January 16, 1990

INVENTOR(S) : Charles C. Quickel

It is certified that error appears in the above-identified patent and that said Letters Patent is hereby corrected as shown below:

Column 2, line 16, "op" should be --top--.

Column 2, line 39, delete reference character "10".

Column 3, Claim 1, delete all words appearing in lines 56-58.

Signed and Sealed this

Eleventh Day of December, 1990

*Attest:*

HARRY F. MANBECK, JR.

*Attesting Officer*

*Commissioner of Patents and Trademarks*